United States Patent [19]

McFarland

[11] Patent Number: 4,619,372

[45] Date of Patent: Oct. 28, 1986

[54] CAP FOR HOT BEVERAGE CUP

[76] Inventor: Joseph R. McFarland, 507 Palo Alto Dr., Vancouver, Wash. 98661

[21] Appl. No.: 854,389

[22] Filed: Apr. 21, 1986

[51] Int. Cl.[4] ..... A47G 19/22; B65D 5/64

[52] U.S. Cl. ..... 220/90.4; 220/90.2; 229/7 R

[58] Field of Search ..... 220/90.2, 90.4, 90.6, 220/366, 367; 229/1.5 B, 7 R

[56] References Cited

U.S. PATENT DOCUMENTS

| | | | |
|---|---|---|---|
| 3,806,023 | 4/1974 | Barnett | 229/1.5 B X |
| 4,394,928 | 7/1983 | Philip | 220/90.4 X |
| 4,503,992 | 3/1985 | Sitko et al. | 220/90.4 |
| 4,566,605 | 1/1986 | Rogers | 229/7 R X |
| 4,574,970 | 3/1986 | Schwarz | 220/90.4 |
| 4,582,214 | 4/1986 | Dart et al. | 220/90.4 |
| 4,589,569 | 5/1986 | Clements | 220/90.4 X |

*Primary Examiner*—Steven M. Pollard

*Attorney, Agent, or Firm*—Chernoff, Vilhauer, McClung & Stenzel

[57] ABSTRACT

A disposable, removable closure cap for a beverage container, including a depression permitting the beverage to be drunk while the cap remains in place on the container, while limiting spillage of liquids held in the container. The cap includes perforations in a depending wall located closely adjacent an inner wall of the container in order to limit the flow of beverage into a depression defined in the upper surface of the cap. A slit in the cap permits the aroma of a beverage to be enjoyed while the beverage is being drunk from the depression. The cap may be formed from sheet plastic material.

13 Claims, 5 Drawing Figures

CAP FOR HOT BEVERAGE CUP

BACKGROUND OF THE INVENTION

The present invention relates to closures for styrofoam cups and the like for beverages, and particularly to such a closure lid or cap which permits the beverage to be drunk with the lid in place, yet resists spillage of the beverage when a cup equipped with such a cap is jostled or carried in a moving vehicle.

Upwardly open beverage cups of foam plastic material are commonly provided as disposable containers for beverages such as coffee and tea sold to be consumed off the premises of the seller, or to be consumed aboard moving public conveyances such as trains and airplanes. It is well known to cover such cups with tightly fitted caps which prevent spillage of the beverage so long as the cap is in place. However, most previously available caps must be removed from the cup before the beverage can be drunk. This presents the risk of spillage of the beverage when one attempts to drink from such a container in a moving vehicle.

Openings have been made in caps to permit insertion of drinking straws, but it is generally not desirable to use a drinking straw for consumption of hot beverages. While the use of a drinking straw is safer, in terms of avoiding spillage, an important part of the enjoyment of many hot beverages is the inhalation of the aroma of the beverage as it is being sipped. It is therefore desired to have a cap which limits spillage of a hot beverage, yet permits the aroma to be enjoyed as the beverage is consumed.

Previously-known attempts to provide a satisfactory solution to this problem are disclosed in Ruff U.S. Pat. Nos. 3,938,695 and 4,085,861. Ruff discloses beverage cup closure lids having depressions whose bottom surfaces are provided with holes through which the beverage can move upwardly into the depression to be drunk without removing the cover from the cup. The cap remains in place above the bulk of the beverage contained in the cup or similar container, even as the beverage is consumed. While such lids do provide a certain amount of limitation of the spillage of a beverage from cups, the provision of holes in the bottom of the depression of such a lid permits an unnecessarily great rate of flow of beverage through the cap, should the container be overturned.

Barnett U.S. Pat. No. 3,806,023 and Wall U.S. Pat. No. 2,601,767 disclose covers which define separate reservoirs atop the main reservoir of a cup or similar container, but which similarly appear to permit an undesirably large rate of flow of beverage contained within, should the container be overturned.

Dibrell U.S. Pat. No. 3,797,696 discloses a non-spill container closure lid having cuts defining depressible flaps which provide some limitation of the amount of possible flow from within the container into an annular channel defined about the periphery of a central dome portion of the lid.

None of the previously available caps for beverage containers of which the present inventor is aware, however, have provided a completely satisfactory, yet inexpensive, solution to the problem of limiting spillage of hot beverages carried in disposable containers for consumption within a moving vehicle. What is desired, then, is an improved cap for a hot beverage container and the like, which permits the beverage to be drunk from the container while the cap remains in place, which permits only a limited rate of flow of fluid from within the container as a result of sudden movement or of the container being overturned, which permits the aroma of the beverage contained within the container to be enjoyed, and which is economical to produce, transport, and store.

SUMMARY OF THE INVENTION

The beverage container closure cap according to the present invention overcomes the shortcomings and disadvantages of the previously known caps for beverage containers by providing a securely sealing fit to the rim of a beverage container, a cover portion of the cap enclosing the open top of the beverage container and defining a depression providing room for the upper lip and the nose of the drinker and including apertures permitting a limited flow of the beverage into the depression, while also permitting escape of the aroma of the beverage from within the container. An outer wall of the depression includes slots which permit an ample flow of a hot beverage for consumption. The outer wall, however, extends closely alongside the interior surface of the container, permitting only a limited rate of flow of the beverage toward the openings extending into the depression. This limits the rate of spillage should the beverage container be overturned. A slit provided in a floor portion of the depression acts as an air vent, permitting entry of air into the interior of the container to replace the volume of beverage consumed. The slit also permits the aroma of the beverage to escape from within the container to the vicinity of the user's nose, so that it can be inhaled and enjoyed. Should the container be overturned, however, the flexible material of which the cap is made allows the sides of the slit to move toward each other under pressure of the beverage against the underside of the floor portion, limiting the amount of beverage which can escape through the slit.

It is therefore a principal objective of the present invention to provide an improved spillage-limiting closure cap for an upwardly-open beverage container, through which a beverage may be consumed without removal of the cap.

It is another important object of the present invention to provide a closure cap which permits the aroma of a beverage contained within a container equipped with the cap to be enjoyed while the beverage is consumed without removal of the cap from the container.

Another object of the present invention is to provide a beverage container closure cap which may be manufactured cheaply enough to be disposable and in a form which can be conveniently transported and dispensed.

An important feature of the present invention is a depression defined partly by an outer wall which extends downwardly parallel with the interior surface of a beverage container, defining slots through which beverage can flow into the depression, at a rate of flow of beverage toward the apertures which is limited by the proximity of the outer wall of the depression to the inner surface of the container.

Another important feature of a preferred embodiment of the present invention is a narrow slit permitting the aroma of a beverage to escape from within a container closed by the closure cap of the invention to the vicinity of the nose of a person drinking from the container with the cap in place.

An important advantage of the closure cap of the present invention is its better ability to limit the amount of spillage of a beverage from a container covered by the closure cap than has been possible previously, although an ample flow of beverage is still available to be drunk from the container while the closure cap is in place on the container.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
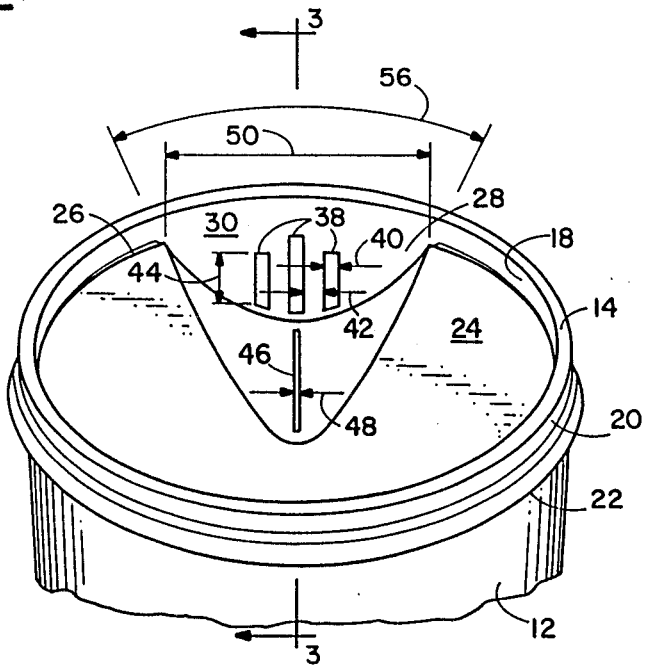
FIG. 1 is a perspective view of a closure cap embodying the invention, shown in place on a hot drink cup.

Referring now to the drawings, the improved cup cap of the present invention is exemplified by the cap 10 shown in FIG. 1 in place on a drinking cup 12. The cup 12 may be, for example, an expanded styrofoam disposable drinking cup of the sort used commonly to contain hot beverages purchased to be taken out for consumption while traveling in an automobile or the like.

The closure cap 10 according to the present invention may be manufactured of a stiff, resilient sheet material, for example, a vacuum-molded sheet plastic such as is commonly used for manufacture of closure caps for cold and hot beverages to be taken from the point of sale and consumed elsewhere. Manufacture of the cap of such material permits the closure caps 10 to be stacked one upon another conveniently for shipping, dispensing, and compact storage of a large number of such closure caps 10.

Figure 3:
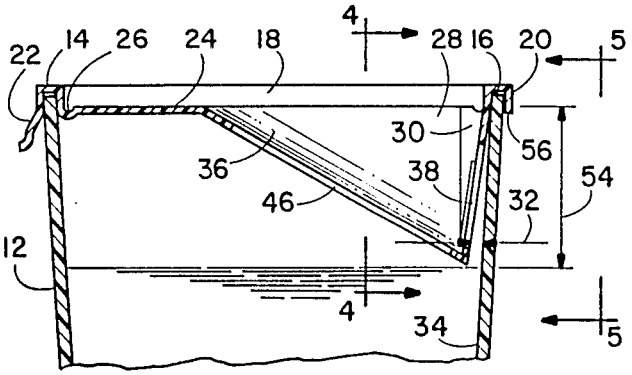
FIG. 3 is a sectional side view of the hot drink cup and the closure cap shown in FIG. 1, taken along line 3—3.
Figure 2:
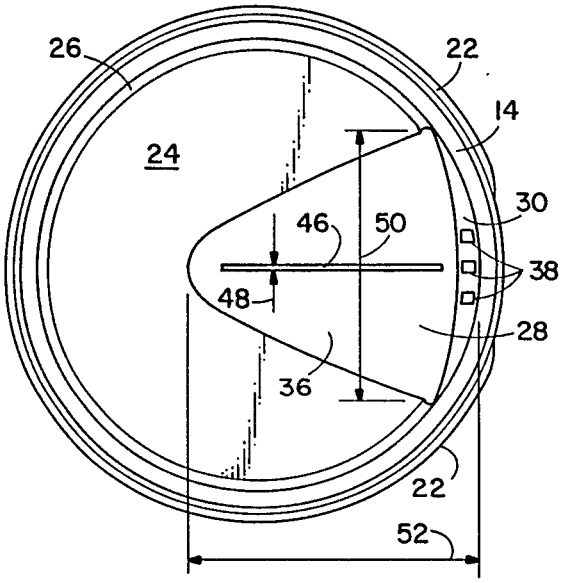
FIG. 2 is a top plan view of the closure cap shown in FIG. 1.

The cup cap 10 includes a peripheral rim portion 14 which resiliently fits snugly atop the lip 16 of the drinking cup 12, as shown also in FIG. 3. An inner dependent portion 18 and an outer dependent portion 20 of the rim portion 14 are separated radially from each other by a distance small enough to cause the cap 10 to resiliently grip the lip 16 to hold the cap sealingly in place atop the drinking cup 12. A generally frustoconical, outwardly-extending skirt 22 extends downward from the outer dependent portion 20.

A main cover portion 24 is generally horizontal, enclosing the area circumscribed by the peripheral rim portion 14, and is connected with the inner dependent portion 18. A shallow, narrow trough 26 may be provided to permit flexure of the inner dependent portion 18 in the well known manner to assure a sealing fit of the cap 10 on the rim 16 of the cup 12 and limit stress in the main cover portion 24.

A depression 28 in the shape of a sector of the cap 10 is defined in the main cover portion 24 circumscribed by the peripheral rim 14. An outer wall portion 30 extends downwardly generally as an extension of a sector of the inner dependent portion 18. The outer wall portion 30 is spaced apart a small distance 32 from the inner surface 34 of the cup 12, but the distance 32 is preferably not more than about $\frac{1}{8}$ inch. The outer wall 30 thus defines one side of a small annular space inside the cup 12.

Figure 4:
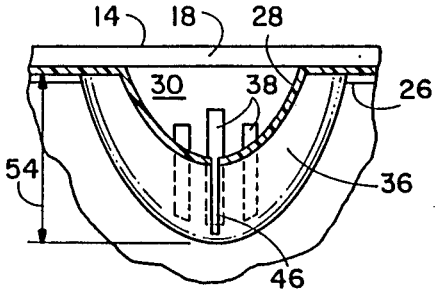
FIG. 4 is a sectional view of the depression portion of the cap shown in FIG. 1, taken along line 4—4 of FIG. 3.
Figure 5:
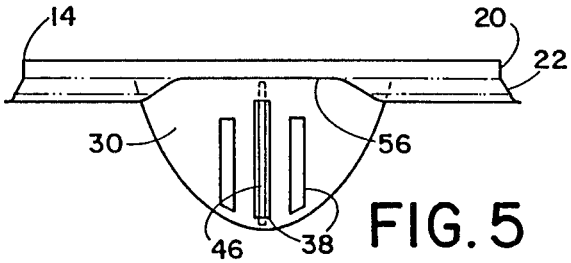
FIG. 5 is a side elevational view of the cup cap shown in FIG. 1, taken along line 5—5 in FIG. 3.

A floor 36 of the depression 28 slopes downwardly from a central portion of the main cover 24 toward the bottom of the outer wall portion 30 and has an upwardly open arcuate shape such as that of a diagonally truncated surface of a cylinder, as may be seen in FIG. 4, although other shapes would also serve and could easily be produced.

A plurality of apertures, preferably elongated narrow slots 38, extend vertically upward from the bottom of the outer wall portion 30. Each of the slots 38 in a preferred embodiment of the invention has a length 44 of $\frac{1}{2}$ to $\frac{5}{8}$ inch and a width 40 of about 1/16 inch to 3/32 inch. The slots 38 are separated laterally from one another by a distance 42 of, for example, $\frac{1}{8}$ inch, which provides ample material between the apertures 38 so that the outer wall portion 30 remains stiff enough to support itself adequately. A total of three slots 38 having a total open area of approximately 9/64 square inch has been found to be satisfactory to permit ample flow of a hot drink such as coffee or tea from the drinking cup 12 into the depression 28 so that the coffee or tea can be drunk without removing the cup cap 10 from the drinking cup 12.

A narrow slit 46 having a width 48 of about 1/64 inch is provided in the floor 36. The size of the slit 46 is sufficient to permit the aroma of a beverage within the drinking cup 12 to be enjoyed as one drinks the beverage from the cup through the cap 10. Since the total sensation of taste of beverages is greatly influenced by the ability to smell, as well as to acquire information from the taste buds, this availability of the aroma is important to enjoyment of the beverage. The slit 46 also permits air to enter the interior of the drinking cup 12, so that the beverage can flow evenly through the slots 38 into the depression 28 when one is drinking a beverage from the depression 28 with the cup 12 tipped up in the usual way.

The depression 28 is of a size which is convenient for engagement by a person's lip to drink the beverage, and simultaneously provides room for the user's nose to enter the depression 28 a short distance, permitting the aroma of the beverage to be inhaled through the nostrils when the cup is tipped. The depression 28 therefore preferably has a width 50 of approximately $1\frac{3}{4}$ inches and a radial dimension or length 52 of at least about $1\frac{3}{4}$ inches and preferably about 2 inches. A preferred depth 54 is approximately $\frac{7}{8}$ inch, measured downwardly from the main cover portion 24 to the bottom of the outer wall portion 30.

The skirt 22 is not present over a segment 56 of the peripheral rim 14 adjacent the depression 28. The outer dependent portion 20, fitting snugly against the lip 16 of the drinking cup 12 where the skirt 22 is not present, provides a comfortable lip of the depression 28 of the cap 10, from which the beverage may be drunk.

Because of the small distance 32 between the outer wall portion 30 and the inner wall surface of the cup 12, only a limited flow of beverage to the slots 38 is normally possible. The narrowness of the slit 46 also limits the flow of beverage which is possible through the cap 10 so that potential spillage of beverage through the cup cap 10 is greatly limited, compared with the possibility of quickly dumping the entire contents of the cup 12, should the cap 10 not be present. Nevertheless, an ample flow of a hot beverage into the depression 28 through the slots 38 is possible when the cup equipped with the cap 10 is tipped in the normal way, elevating the slit 46 so that it acts as a vent to admit air into the interior of the cup 12. Should the cup be tipped over, however, pressure of liquid against the underside of the cup cap 10 will press against the floor 36, urging opposite sides of the slit 46 toward one another, and tending to close the slit 46. Simultaneously, the small distance 32 between the outer wall portion 30 and the inner surface 34 of the cup 12 limits the amount of beverage which can flow outward through the slots 38. At the same time, the attempt of air to flow into the interior of the cup through the apertures 38 opposes the outward flow of the beverage through the apertures 38.

When a cup equipped with the closure cap 10 is inclined in the normal fashion to consume beverage from the container, the slots 38 will be at a location where the pressure exerted will be ample to force sufficient quantities of the beverage through them. Should the container covered by the cap 10 be overturned or jostled, however, the beverage is much more likely to be blocked by the cover portion 24 of the cap 10 than it is to flow toward the apertures 38.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A detachable closure cap for a beverage container having a circular opening defining a lip, comprising:

(a) peripheral means for sealingly engaging the lip of said beverage container;

(b) a main cover portion generally horizontally disposed and circumscribed by said peripheral means;

(c) means for defining a depression adjoining said main cover portion and located within said peripheral means;

(d) downwardly-extending outer wall means, included in said means for defining a depression, for defining one side of a narrow annular space alongside an interior surface of a beverage container;

(e) a sloping floor member included in said depression and extending diagonally upward from a lower portion of said outer wall means to said main cover portion;

(f) means for defining a plurality of apertures extending through said outer wall means; and (g) means for defining a slit through said floor means, said slit extending along said floor means generally radially of the portion of said closure cap defined within said peripheral means and located between said outer wall means and said main cover portion.

2. The detachable closure cap of claim 1 wherein said plurality of apertures includes a plurality of generally vertically-oriented, elongate slots for fluid passage.

3. The detachable closure cap of claim 1 wherein said outer wall means is frusto-conical in form.

4. The closure cap of claim 3 wherein said plurality of apertures includes a plurality of generally vertically-extending, elongate slots.

5. The closure cap of claim 1 wherein said floor member defines a generally cylindrical surface and said slit is oriented longitudinally along said cylindrical surface.

6. The closure cap of claim 1, said cap being made of a resilient sheet plastics material.

7. The closure cap of claim 6, wherein said peripheral means includes a dependent frusto-conical skirt member attached thereto, said skirt member being absent from a sector of said peripheral means adjacent said depression.

8. The closure cap of claim 1 wherein said depression is approximately 1 inch deep.

9. The closure cap of claim 8 wherein said depression is approximately $1\frac{3}{4}$ inches wide.

10. The closure cap of claim 8 wherein said depression has a radial dimension of at least approximately $1\frac{3}{4}$ inch.

11. The closure cap of claim 1 wherein said outer wall means is oriented so as to be parallel with and spaced apart no farther than about $\frac{1}{8}$ inch from an interior wall of a cup closed by said cap.

12. The closure cap of claim 1, said cap being made of a molded sheet plastic material.

13. The closure cap of claim 1 wherein said peripheral means includes means for resiliently gripping the lip of a cup.

* * * * *